United States Patent [19]

Lester

[11] 4,038,126

[45] July 26, 1977

[54] METHOD FOR FORMING TABLE AND BENCH CONSTRUCTION

[75] Inventor: Fritz O. Lester, Kalamazoo, Mich.

[73] Assignee: Liane E. Lester, Kalamazoo, Mich.

[21] Appl. No.: 659,640

[22] Filed: Feb. 20, 1976

Related U.S. Application Data

[62] Division of Ser. No. 419,675, Nov. 28, 1973, Pat. No. 3,968,755.

[51] Int. Cl.[2] ..... B32B 7/12; B32B 3/08; B32B 31/26

[52] U.S. Cl. ..... 156/290; 52/415; 52/614; 52/626; 156/297; 156/304; 428/45; 428/57

[58] Field of Search ..... 156/157, 297, 304, 306, 156/309, 196, 212, 290; 428/44, 45, 46, 54, 57, 58, 542; 108/59, 150, 90; 52/614, 626, 415; 211/153; 273/136 GB, 136 Z

[56] References Cited

U.S. PATENT DOCUMENTS

| | | | |
|---|---|---|---|
| 2,013,865 | 9/1935 | Sloan | 156/297 X |
| 3,053,726 | 9/1962 | Larson et al. | 156/304 |
| 3,174,893 | 3/1965 | Church et al. | 428/46 X |

FOREIGN PATENT DOCUMENTS

| | | | |
|---|---|---|---|
| 842,782 | 7/1960 | United Kingdom | 156/304 |

*Primary Examiner*—William A. Powell
*Assistant Examiner*—Thomas Bokan
*Attorney, Agent, or Firm*—Gordon W. Hueschen

[57] ABSTRACT

A table or bench construction comprising in combination a pillar or plurality of bench legs each formed of a plurality of elongate members and spacer members affixed to and maintaining the elongate members in spaced-apart configuration, pedestal means having joint means for engaging the lower end of the pillar for supporting the pillar in a vertical position on a horizontal surface, a table top or bench top support comprising joint means adapted to engage the upper end of the pillar or leg having a plurality of horizontally extending arms, and a table top or bench top. A table top or bench top frame is provided having a T-form cross-section adapted to engage the horizontally extending arms and the table top or bench top. In a method comprising a modified embodiment of the invention, the table top or bench top may be coated with a heat-softening adhesive and sectors thereof may be affixed together in place on the supporting frame by spot heating the adhesive with a torch or heated iron.

3 Claims, 23 Drawing Figures

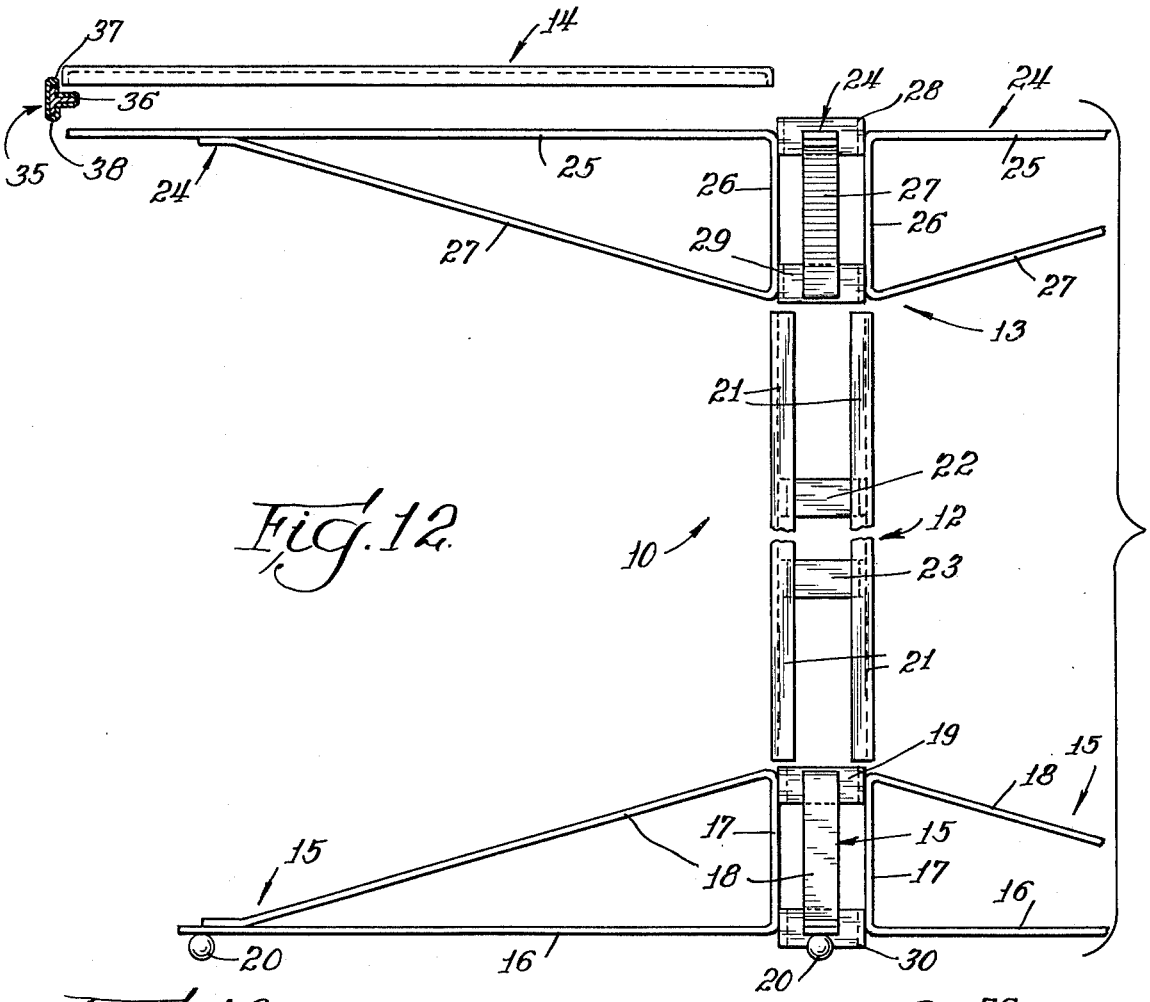
Fig. 12.
Fig. 13.
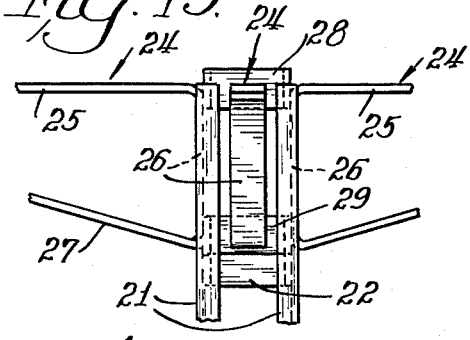
Fig. 16.
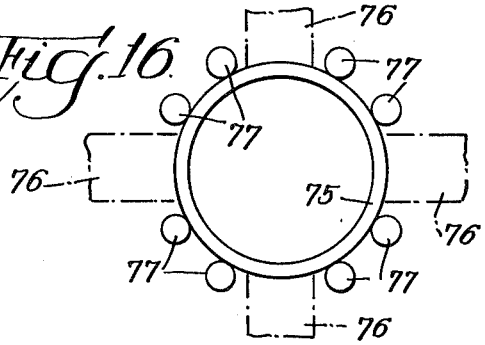
Fig. 14
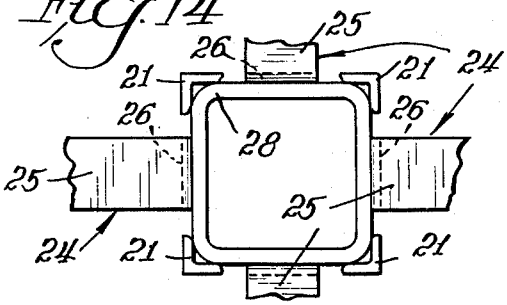
Fig. 15.
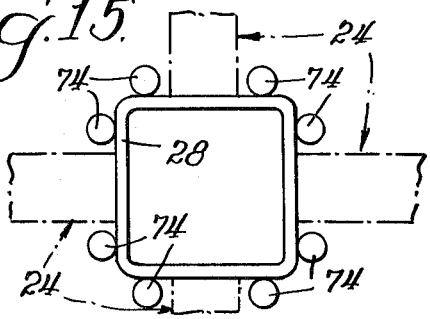

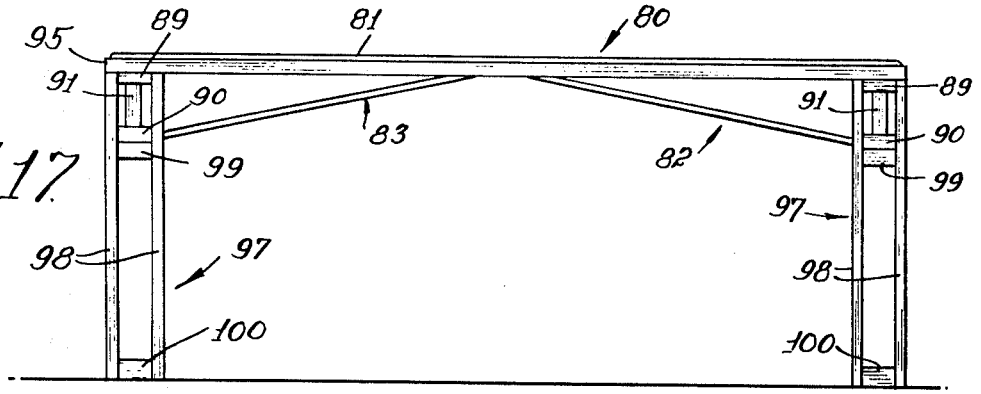
Fig. 17
Fig. 18
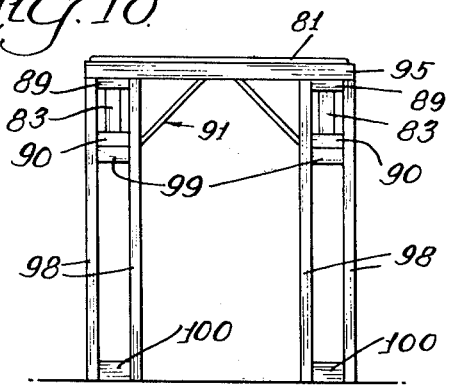
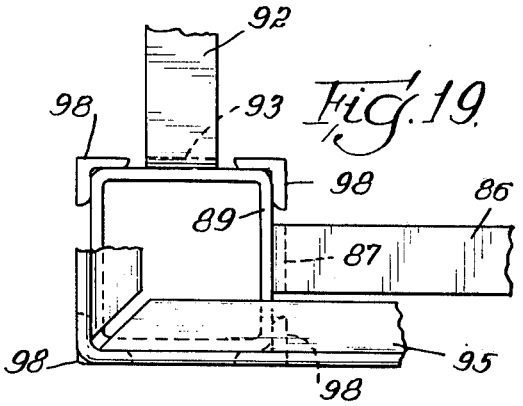
Fig. 19
Fig. 21
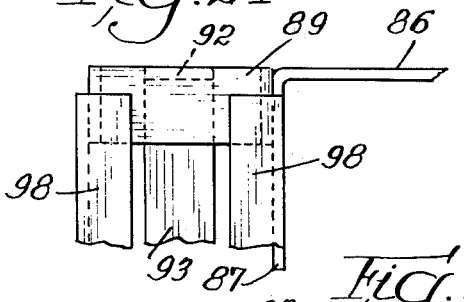
Fig. 20
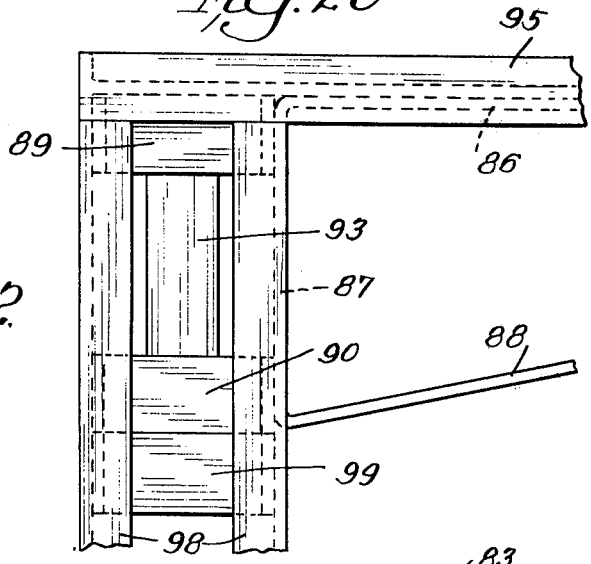
Fig. 22
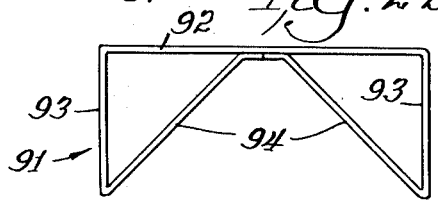
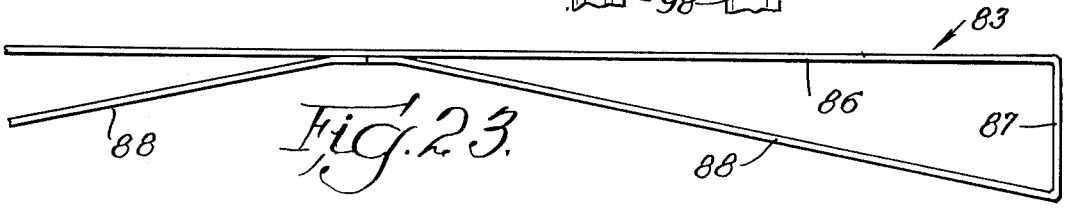
Fig. 23

METHOD FOR FORMING TABLE AND BENCH CONSTRUCTION

This is a division of application Ser. No. 419,675, filed Nov. 28, 1973, which issued July 13, 1976, as U.S. Pat. No. 3,968,755.

BACKGROUND OF THE INVENTION

1. Field of Invention

The present invention relates to table and bench constructions and more particularly refers to novel knock-down table and bench constructions having a novel pillar or leg structure and novel means of connecting the pillar to a base or leg support, and to a table top or bench top.

2. Prior Art

Many forms of knock-down tables have been disclosed in the art. Some structures have proven to be weak and unsteady when erected and not wholly satisfactory. Other knock-down tables, although structurally secure when assembled, are complicated and require expensive parts and machining.

OBJECTS OF THE INVENTION

It is an object of the invention to provide table and bench structures having novel pillars or legs and novel structures for retaining same. It is a further object to provide a table or bench structure of the type described which may be shipped in knock-down form and quickly assembled and disassembled. It is a further object to provide a table structure having a base and a table top support which are substantially interchangeable. It is still further an object to provide a table top and bench top construction which may be formed in various shapes and colors and which tops are readily interchangeable and mountable on the same pillar or legs, and which can be interchanged to provide desirable shapes or colors. It is still an additional object to provide a table and bench structure having a table top or bench top formed of a plurality of sectors provided with a heat-softening coating, and which sectors may be secured together by spot heating. It is still further an object to provide a table and bench structure of the type described which has an attractive appearance and which is secure when fully assembled. It is still an additional object to provide a table and bench structure which may be fabricated of readily available materials and which may be fabricated economically. Still other objects will readily present themselves to one skilled in the art upon reference to the ensuing specification, the drawings, and the claims.

BRIEF DESCRIPTION OF THE DRAWINGS

In the drawings,

FIG. 12 is an exploded side elevational view of the table of FIG. 1 showing various sub-assemblies and manner of fitting together.

FIG. 13 is a fragmentary side elevational view showing the table top supporting member of FIG. 12 mounted on the pillar.

FIG. 14 is a fragmentary enlarged top view of the structure of FIG. 13.

FIG. 15 is an enlarged fragmentary top view of a modified structure showing pillar members having a circular cross-section.

FIG. 16 is a fragmentary enlarged top view of an assembly similar to that of FIG. 14 but showing a round tubular support or joint member and pillar members having a round cross-section.

FIG. 17 is a side elvational view of a bench utilizing the construction of the table described above.

FIG. 18 is an end elevational view of the bench shown in FIG. 17.

FIG. 19 is a top view of one corner of the bench of FIG. 17 with parts broken away.

FIG. 20 is a fragmentary side view showing the structure of FIG. 19.

FIG. 21 is a fragmentary view similar to FIG. 20 but with the top frame removed.

FIG. 22 is a side elvational view of the end braces, and

FIG. 23 is a fragmentary side elevational view of the front braces.

DESCRIPTION OF THE PREFERRED EMBODIMENTS

Figure 1:
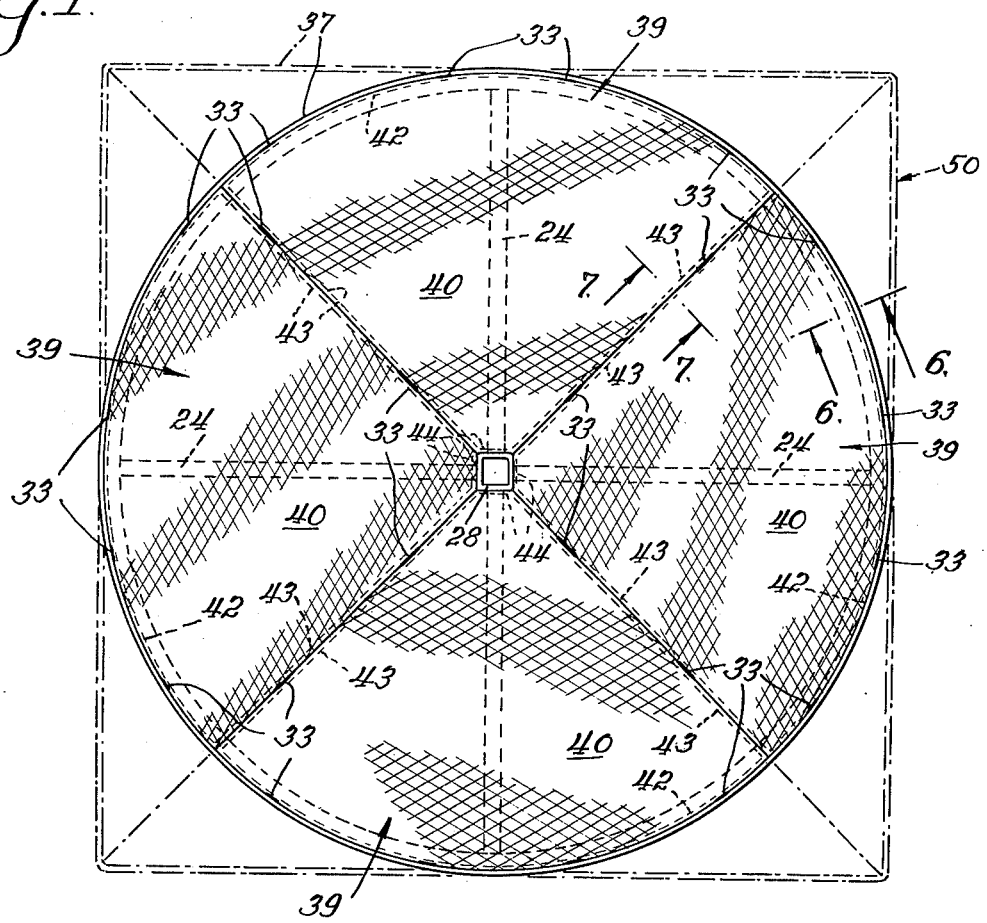
FIG. 1 is a top view of a table according to the invention showing a round table top in solids lines and a square table top in phantom or hypothetical lines.
Figure 2:
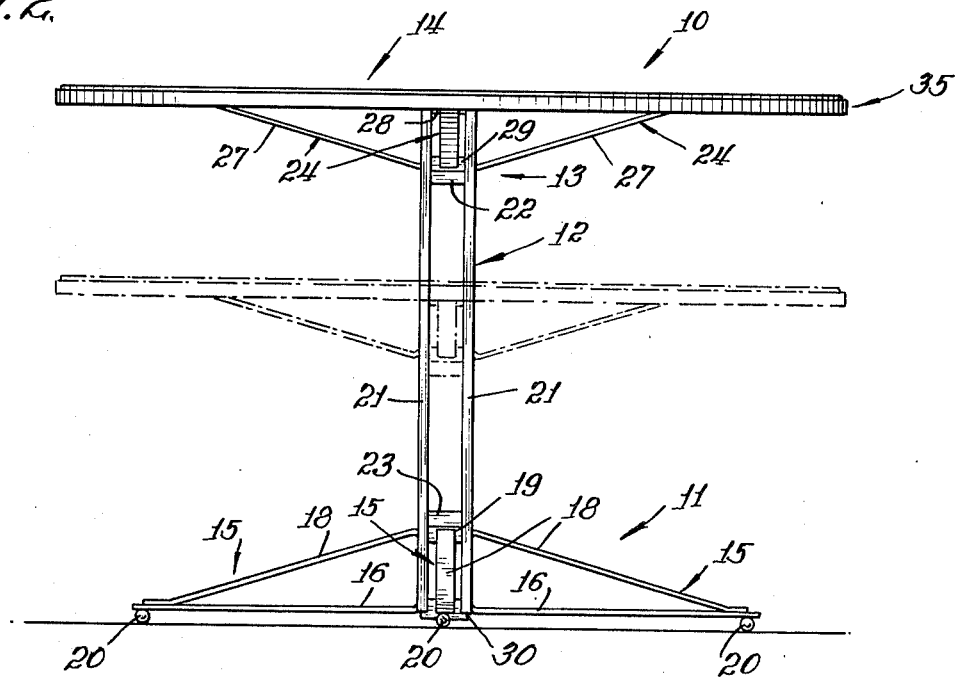
FIG. 2 is a side elevational view of the table of FIG. 1 showing a table of full height in solid lines and a coffee or cocktail table of lower height in dotted lines.

Referring to FIGS. 1, 2, 3, 6, 7, 12, 13, and 14, a table assembly 10 according to the invention is shown. The table assembly 10 comprises a leg assembly or pedestal 11, a pillar assembly 12, a table top support 13, and a table top 14. The leg assembly 11 comprises four legs 15, each formed of material such as iron strap or bar material having a horizontal leg member 16, a vertical leg member 17, and an inclined leg member 18 having its ends preferably affixed to the horizontal leg member 16, shown in greater detail in FIG. 12. The legs 15 are affixed to a pair of square tubular seections forming joint members 19 and 30. Floor-engaging supports 20 such as balls, cylinders, or other forms, are affixed at the ends of the legs 15.

The pillar assembly 12 comprises four elongate pillar members 21 formed of angle stock and supported in spaced-apart relationship by square tubular pillar member supports or spacers 22 and 23, being of similar shape to that of the tubular members 19 and 30. The pillar members 21 are so positioned that they engage and slide over the tubular members 19 and 30 and come to rest with the tubular members 23 in engagement with the tubular member 19. In this poisiton the pillar assembly 12 is firmly grasped and supported by the leg assembly 11.

The table top support 13 is similar to the leg assembly 11 and comprises four table top support arms 24, each comprising a horizontal arm member 25, a vertical arm member 26, and an inclined arm member 27. The arms 24 are affixed together by two square tubular arm support or joint members 28 and 29 by welding to form a spider-like arm assembly. The square tubular arm support and joint members 28 and 29 are of substantially the same size and shape as the square pillar member supports or spacers 22 and 23. Consequently, the table top support 13 slides into the space defined by the pillar members 21 until the tubular arm support and joint member 29 comes into engagement with the pillar member support 22. The table top support 13 is now maintained firmly in place, but may be demounted by lifting. The ends of the horizontal arm members 25 and the inclined arm members 27 are affixed together as by welding, forming a strong table top support.

An annular flange member or frame 35 (FIGS. 6 and 12) is mounted over the table top support 13. The annular flange member 35 is continuous and encircles the ends of the entire table top support 13, and comprises a radial flange 36, an ascending axial flange 37, and a descending axial flange 38. The radial flange 36 rests on the ends of the arms 24 and the descending flange 38 prevents the flange member 35 from sliding off the table top support 13.

Figure 3:
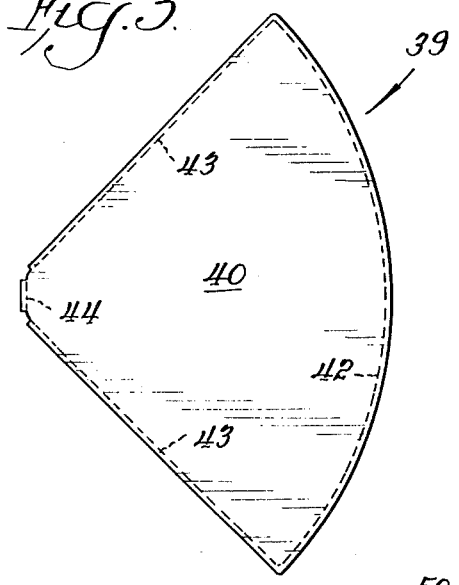
FIG. 3 is a top view of one table top member of a round table top.

The table top may alternatively be formed of a single integral piece of sheet metal and preferably perforated to form a screen pattern, or may be made in sectors as shown in FIGS. 1, 3, and 12. In the structure shown in the latter named figures, the table top comprises a plurality of table top sectors 39 (FIG. 3) intergrally formed having a perforated top surface 40 with arcuate depending flanges 42, radial depending flanges 43, and a central depending flange 44.

The table top is assembled by first placing the annular flange member 35 over the table top support 13. The table top sectors 39 are then placed over the flange member 35 which rests on the table top support arms 34. If desired, the arcuate flanges 42 may be affixed to the annular flange member 35 by means of a heat-softening adhesive and the radial depending flanges 43 of adjecent sectors 39 may be affixed to each other in similar manner, as described below.

Figure 4:
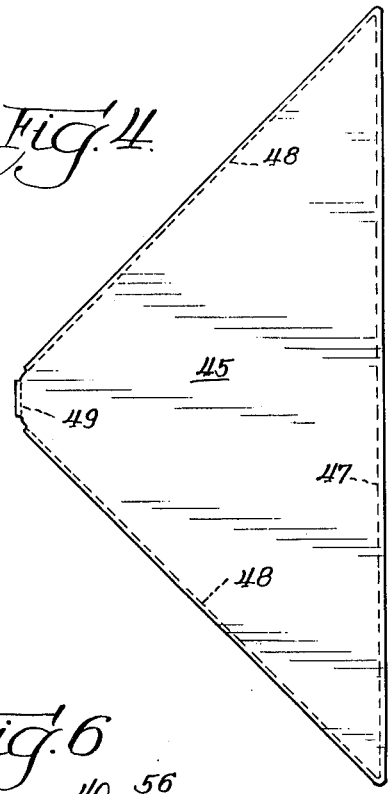
FIG. 4 is a top view of a table top member of a square table top.
Figure 5:
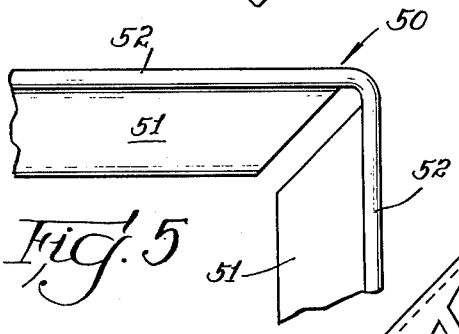
FIG. 5 is a fragmentary top view of a corner of a frame for a square table top or bench top.

Referring to FIG. 4, a table top sector 45 is shown for forming a square table utilizing four sectors. The sector 45 comprises a table top surface wich may have apertures provided therein and depending flanges 47, 48, and 49. The sectors are mounted in a square frame 50, shown in FIGS. 1 and 5, having radial flange 51 and axial flanges 52 (FIG. 5).

Figure 6:
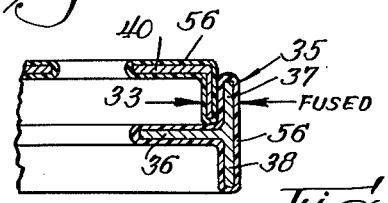
FIG. 6 is fragmentary sectional view taken at the line 6—6 of FIG. 1, looking in the direction of the arrows, showing a depending flange of a top member supported on a T-form cross-section frame.
Figure 7:
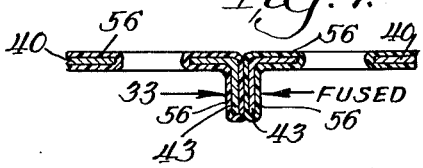
FIG. 7 is a fragmentary sectional view taken at the line 7—7 of FIG. 1, looking in the direction of the arrows, showing a joint of adjacent table top sectors.

As shown in FIG. 6, the annular flange member or frame 35 and the arcuate depending flanges 42 and even the entire table top may be coated with an adhesive material 56 which is heat softening. After the table top sectors are assembled in place, heat may be applied with a flame or with a heated iron to cause the adhesive material to fuse in limited 33 (FIG. 1), thereby adhesively affixing the table top sectors to each other and to the frame or annular flange member 35 (FIG. 7). This provides an excellent bond which permanently maintains the table top sectors in place. Any common heat-fusable adhesive material may be utliized.

Although the table top of the invention may be utilized as a solid piece of sheet metal, it is desirable for many applications to have the top provided with apertures to create a mesh-type effect.

Figure 8:
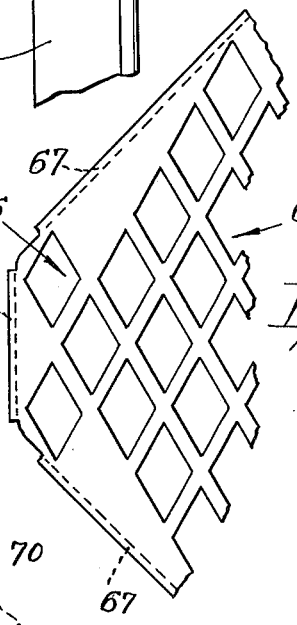
FIG. 8 is a fragmentary top view of a table top showing one form of perforations or apertures.

FIG. 8 illustrates a portion of a table top sector 65 having diamond-shaped apertures 66. Flanges 67 and 68 are provided for mounting in a frame.

Figure 9:
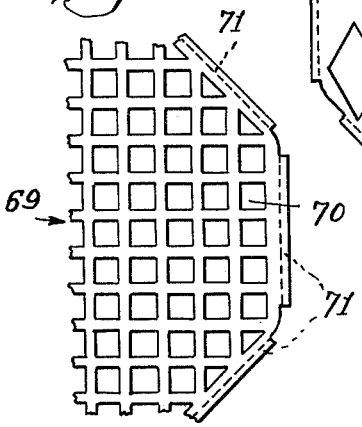
FIG. 9 is a fragmentary top view of a table top sector showing perforations or apertures of a different shape or of square shape.

FIG. 9 illustrates a segment of a table top 69 having square apertures 70 and depending flanges 71.

Figure 10:
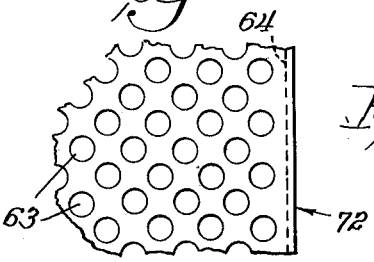
FIG. 10 is a fragmentary top view of a table top sector showing perforations or apertures of circular shape.

FIG. 10 illustrates a segment of a table top 72 having circular apertures 63 and depending flanges 64.

Figure 11:
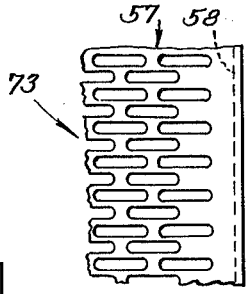
FIG. 11 is a fragmentary top view of a table top sector showing perforations or apertures in the form of elongate slots.

FIG. 11 illustrates a segment of a table top 73 having elongated slot apertures 57 and a depending flange 58.

In the embodiments of the invention discussed previously, the pillar assembly is in the form of an angle stock supported by pillar member supports or spacers 22 and 23 to define a square socket adapted to slide over the square tubular support members 28, 29, 19, and 30. As illustrated in FIG. 15, the pillar members 74 may be elongate rods of circular cross-section arranged to define a square socket adapted to receive the square tubular support member 28. The pillar members 74 are maintained in position by square tubular support members similar to those designated by the numerals 22 and 23 in FIG. 12. The pillars formed of the circular members insert into the leg assembly 11 or table top support 13 in the same manner as the angle-form pillar members.

FIG. 16 illustrates a pillar structure and portion of a table top support 13 having a tubular leg or arm support 75, arms 76 similar to that shown in the previous drawing, and elongate rod-form pillar members 77 of circular cross-section similar to those shown in FIG. 15. The pillar members 77 are held together by circular tubular members such as 75.

Referring to FIGS. 17–23, a bench stucture 80 is shown utilizing the basic pillar and socket structure of the table described above to form a bench structure. The structure comprises a bench top 81 having a support 82. The support 82 is comprised of lingitudinal braces or members 83 formed of material such as strap metal, and as shown particularly in FIG. 23, each comprising a horizontal member 86, vertical members 87, and inclined members 88, the ends of the inclined members 88 being affixed at their ends to the horizontal members 86. The vertical members 87 are welded to a pair of square tubular socket or joint members 89 and 90. A pair or transverse support members 91 complete the support 82, and, as shown in detail in FIG. 22, each comprise a horizontal member 92, a pair of vertical members 93 and a pair of diagonal members 94 having their ends affixed by welding to the horizontal member 92. The support members are also welded to the joint members 89 and 90 (FIG. 19).

The legs 97 have a structure similar to that of the pillars utilized in the table embodiments previously discussed. Each leg comprises four leg members 98 having an angle-form cross-section secured in position by a pair of square tubular support members 99 and 100. A frame 95 having a shape and cross-section similar to that of FIG. 5, having radial flanges 51 and axial flanges 52 is mounted over the joint members 89, and the bench top 81 then mounted in the frame.

The bench is assembled by first inserting the ends of the leg members over the joint members 89 and 90. The frame 95 is then placed over the support with the radial flange 51 thereof supported by the joint members 89.

The bench top 81 is then inserted in the frame resting on the radial flange 51.

The tables and benches of the present invention may be made of any of a large number of suitable materials. The table top may be made of sheet steel or aluminum and may be preforated in any desirable pattern. Additionally expanded metal may be used. Plastics sheets of the proper physical properties may also be utilized. The tubular support members for the arms and legs and to support the pillar members may be made of cut steel or aluminum tubular stock, being of square, round, or any other desirable cross-section. Although the supporting members have been shown and described as being tubular, it is, of course, clear that other shaped pieces such as solid discs may be utilized since the supporting members are positioned inside the pillars and inside the leg and arm supports or joint-or socket-forming supports. The pillar members may be in the form of angled stock, rods of round cross-section, or any of many other shaped rods.

Any type of protective coating may be utilized to cover the table top and/or the other parts of the structure. In one form of the invention it is desirable to use a heat-softening adhesive type paint such as of the epoxy type, polyester, vinyl, polyurethane, etc. The various sectors of each table top can then be permanently affixed by spot heating with a torch or iron, and this can also be done to affix the edges of the table top to the supporting frame.

The table and bench structure of the present invention has many advantages over prior art structures. All the component parts may be readily formed of available stock such as angled, sheet metal, and tubular stock. The pillar may readily be mounted into and out of the suppoting structure of the pedestal or floor support, and the table top support may readily be removed from the pedestal, permitting table tops of various shaped and colors to be utilized interchangeably, and pillar structures of various typed and lengths may be utilized so that, for example, the table can be set up either as a standard table or as a low coffee table. The structure also lends itself for fabricating benches which are readily assembled and readily dismounted for storage. The components are relatively simple to construct and relatively inexpensive to produce.

It is to be understood that the invention is not to be limited to the exact details of operation or structure shown and described, as obvious modifications and equivalents will be apparent to one skilled in the art.

I claim:

1. A method of forming a table top comprising forming a plurality of table top sectors having depending flanges, coating said sectors with a heat-softening adhesive, assembling said sectors into engagement with each other with flanges of each sector abutting a flange of each adjacent sector, and spot heating said sectors at abutting flanges to cause said sectors to adhere to each other.

2. A method according to claim 1, having the additional step of providing a frame for said table top, coating abutting portions of said frame and said table top with a heat-softening adhesive, and spot heating abutting portions of said table top and said frame at selected areas to cause table top adhesively affixed to said frame.

3. A method according to claim 2, in which said abutting portions of said frame and said table top comprise a peripheral flange depending from said table top and a peripheral flange upstanding from said frame and in which the spot heating is applied to the depending flange.

* * * * *